US005251426A

United States Patent [19]

Heisler et al.

[11] Patent Number: 5,251,426

[45] Date of Patent: Oct. 12, 1993

[54] METHOD AND APPARATUS FOR CONVEYING STACKS OF NESTED PREFORMED LIDS

[76] Inventors: Rick Heisler, 21 Colgate Rd., Oakland, N.J. 07436; Ronald Heisler, 45 Snake Den Rd., Wanaque, N.J. 07465; John Taylor, 218 Zabriskie Pl., New Milford, N.J. 07645

[21] Appl. No.: 990,399

[22] Filed: Dec. 15, 1992

[51] Int. Cl.[5] ..... B65B 7/28; B65B 43/44

[52] U.S. Cl. ..... 53/485; 53/168; 53/287; 53/310

[58] Field of Search ..... 53/485, 488, 489, 490, 53/313, 314, 315, 310, 309, 306, 311, 287, 168, 505, 68; 493/120, 102

[56] References Cited

U.S. PATENT DOCUMENTS

| | | | |
|---|---|---|---|
| 3,867,807 | 2/1975 | Doucette | 53/314 X |
| 3,938,697 | 2/1976 | Kinney | 53/313 X |
| 4,072,090 | 2/1978 | Heisler | 493/36 |
| 4,601,160 | 7/1986 | Heisler | 53/485 |
| 4,691,501 | 9/1987 | King | 53/313 X |
| 4,949,526 | 8/1990 | Brogna et al. | 53/310 X |

*Primary Examiner*—James F. Coan

*Attorney, Agent, or Firm*—Patrick J. Pinto

[57] ABSTRACT

An apparatus and method for the automatic on-demand conveying of stacks of nested lids to a lid placer employing two powered sections for first elevating the stacks of nested lids placed on a platform assembly then, shuttling the elevated nested stack interior of a guide assembly from a first position to a second position, the guide assembly then acts as an extension of the magazine of the lid placer until a predetermined quantity of lids have been separated and placed.

13 Claims, 4 Drawing Sheets

METHOD AND APPARATUS FOR CONVEYING STACKS OF NESTED PREFORMED LIDS

FIELD OF THE INVENTION

With regard to the classification of art, this invention is believed to be found in the class pertaining to CONVEYING OF GROUPED OR STACKED ARTICLES and more particularly to methods and apparatus for MOVING THE STACKED AND NESTED ARTICLES IN AT LEAST TWO DIRECTIONS. This method and apparatus includes a t least two powered sections for elevating the stacked articles to a first position then shuttling the stacked articles horizontally from the first position to a second position.

DESCRIPTION OF THE PRIOR ART

This method and apparatus is intended to be used with automatically operated lid separating and placing equipment. One example of the type of lid placing equipment is U.S. Pat. No. 4,601,160 issued to Heisler on July 22, 1986. It has been found that some lid placer installations will not allow the automatic feeding of the lids, as shown in FIG. 13. This feeding method is more fully described in U.S. Pat. No. 4,072,090 as issued to Heisler on February 7, 1978 Some of the problems encountered are space consideration; the height of the lid reservoir; and economical use of man power.

It has been found that there is a need for an automatic apparatus for delivering stacks of nested lids to a magazine of lid separating and placing apparatus such as Heislet U.S. Pat. No. 4,601,160. The needed apparatus should be automatically responsive to the demands of the lid placing equipment while at the same time being economical in the use of man power. Such an apparatus would provide a means for receiving stacks of nested lids at or near normal working level then automatically deposit the stacked lids into the magazine of the lid placer as needed. None of the known prior art lid placers disclose the needed lid conveying apparatus or method.

The present invention solves the above described need, by providing a method and apparatus which is adaptable to various physical conditions in a processing plant.

SUMMARY OF THE INVENTION

This invention may be summarized in part with respect to its objectives. It is an object of this invention to provide and it does provide a method and apparatus for the on demand conveying of nested stacks of lids to a magazine of a lid placer apparatus.

It is also an object of this invention to provide and it does provide a method and apparatus for receiving stacks of nested lids at or near a normal working level. Then conveying the stack of nested lids so that they may be deposited in an elevated magazine of the lid placer.

It is another object of this invention to provide a method and apparatus for the on demand conveying of stacks of nested lids to a magazine of a lid placer in which the operation is automatically controlled.

It is still another object of this invention to provide an apparatus and method for the on demand conveying of nested stacks of lids in which said apparatus and method are adaptable for operation with an infeed conveyor which may accumulate multiple stacks of nested lids.

It is still a further object of this invention to provide and it does provide an apparatus for the on demand conveying of stacks of nested lids which is adaptable for various type of lid placer equipment.

In addition to the above summary, the following disclosure is detailed to insure adequacy and aid in the understanding of this invention. This disclosure, however, is not intended to cover each new inventive concept no matter how it may be disguised either by variations in form or additions by further improvements. For this reason, there has been chosen specific embodiments of a method and apparatus for the on demand conveying of a stack of nested lids to a magazine of a lid placer. The specific embodiments have been chosen for the purpose of illustration and description as shown in the accompanying drawings wherein:

Figure 1:
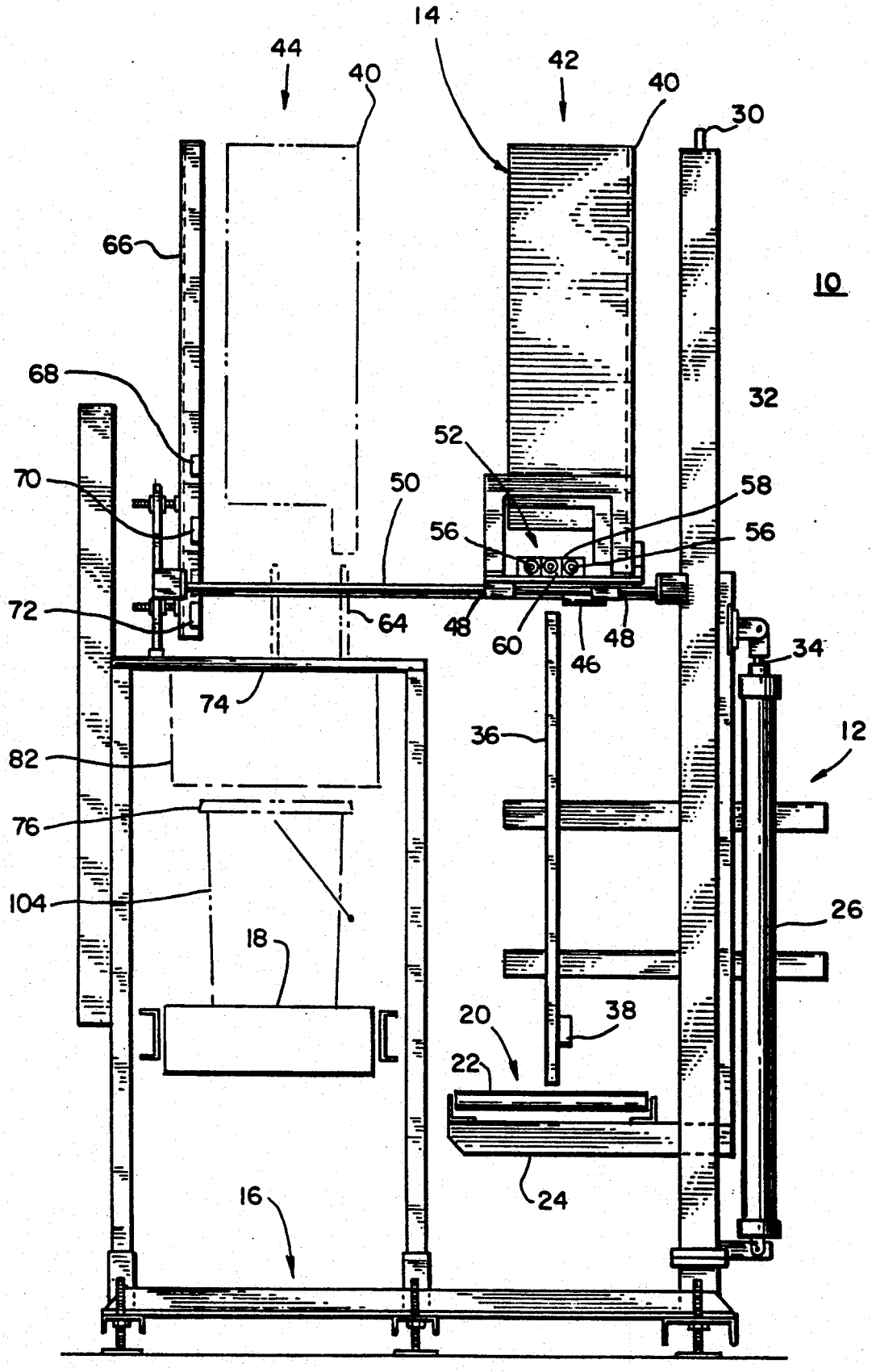
FIG. 1 represents a front elevational view of the present invention.

In the following description and in the claims, various details are identified by specific names for convenience. These names are intended to be generic in their application while differentiating between the various details. Corresponding reference characters refer to like members throughout the several figures of the drawings.

The drawing accompanying, and forming a part of this specification disclose details of construction for the sole purpose of explanation. It is understood that structural details may be modified without departing from the concept and principles of the invention. This invention may be incorporated in other structural forms than shown.

DETAILED DESCRIPTION OF FIG. I AND 2

Referring to FIG. 1, there is shown one view of an apparatus for the on demand conveying of stacks of nested lids. This preferred embodiment of the the present invention is generally identified as 10. This apparatus 10 includes a platform assembly 12 and a guide assembly 14. The platform assembly 12 and the guide assembly 14 are supported by a common frame 16. Preferably apparatus 10 also provides a mounting means for a lid placer apparatus such as U.S. Pat. No. 4,601,160, which is not shown. This frame 16 is constructed. to straddle a conveyor 18 which carries a container to be covered. The frame 16 should meet all safety and structural requirements. The safety requirements of course must include safety guards and interlocks.

Still referring to FIG. 1, the platform assembly 12 is of the elevator type. More specifically, a platform 20 is adapted to receive a stack of nested lids thereon. In its preferred form, the platform 20 may include a plurality of rollers 22 which are rotatably carried by an L-shaped platform support 24. The use of the rollers 22 is preferred when the present invention is used with an infeed conveyor, which may be seen in FIG. 5. Referring again to FIG. 1 the platform 20 may have a stationary plate or grid substituted for the rollers 22 when an infeed conveyor is not used.

Figure 2:
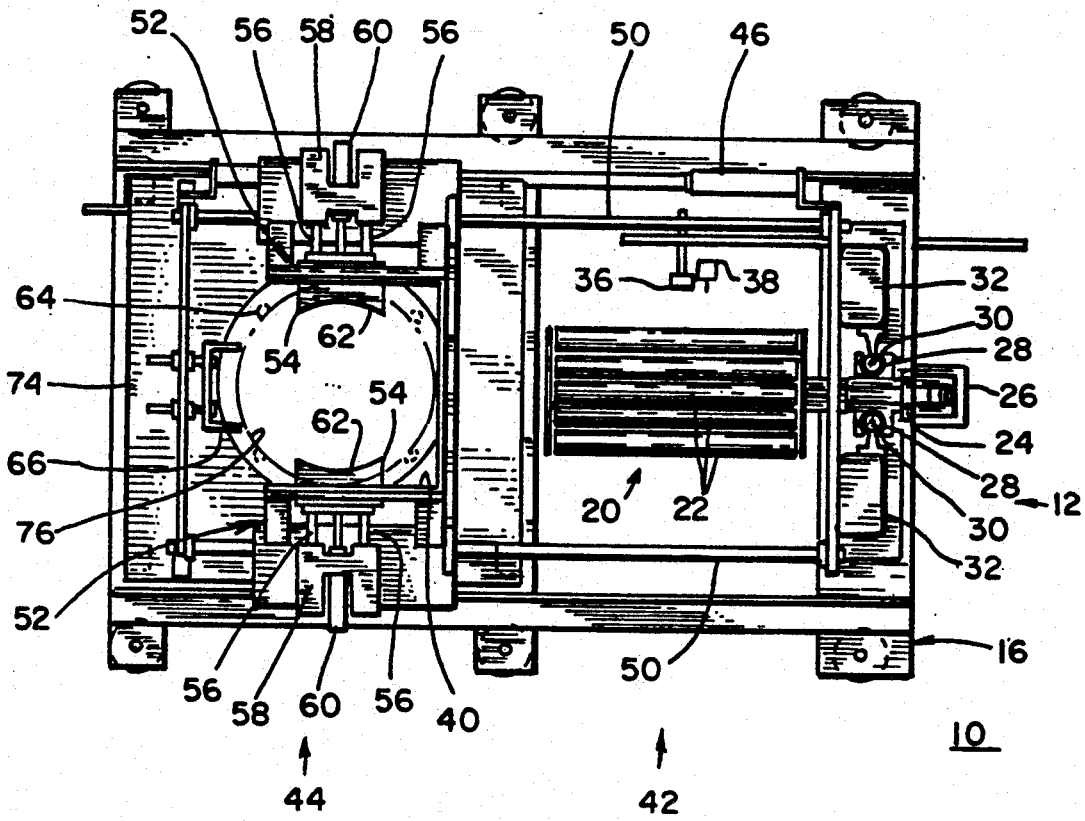
FIG. 2 represents a plan view of the apparatus in FIG. 1, this view being partially diagrammatic.

Referring now to FIGS. 1 and 2, the platform assembly 12 of the present invention is adapted to be selectively moved from its lowermost position, as seen in FIG. 1, to an uppermost position. The uppermost position will be described later in connection with FIG. 3C. The L-shaped platform support 24 is selectively moved between the lowermost position and the upper most position by way of a first linear actuator 26, such as a pneumatic cylinder, hydraulic cylinder or the like.

Still referring to FIGS. 1 and 2, the vertical movement of the L-shaped support 24 is guided by a plurality of bushings 28 which are mounted therein. Each bushing 28 is designed for linear movement, such as a sleeve bushing, ball bushing or the like. The bushings 28 are linearly guided by at least two stationary shaft members 30. These shaft members 30 are supported by a pair of columns 32. Preferably each of the shaft members 30 has intermediate supports which are mounted to the column 32. This arrangement provides for a compact design. When intermediate supports are used an open type of ball bushing is used. Referring in particular to FIG. 1 the L-shaped support 24 is attached to the piston rod 34 of the actuator 26 by means of a clevis arrangement. Preferably, the body of the linear actuator 16 is pivotally attached to the frame 16. It has been found that a clevis mounting arrangement at an end of the actuator, distal the piston rod end, as seen in FIG. 1, gives the desired results.

Still referring to FIG. 1, the platform assembly 12 includes a stop bar 36 which is adjustably mounted to the frame 16. This stop bar 36 provides one locating means for the stack of nested lids being received on the plaftorm 20. This stop bar 36 also provides a convenient mounting for a first detecting means 38. This first detecting means 38 is primarily used in conjunction with the automatic on-demand operation of the present invention, which will be discussed later.

Referring again to FIG. 1 and 2, the guide assembly 14 includes a guide means 40 which is formed in a U-shape. This U-shape provides a guidance for the nested stack placed therein. The guide means 40 is moveably mounted to the frame 16 by way of a powered shuttle arrangement. This shuttle arrangment allows for the selective horizontal movement of the guide means 40 between a first position 42 and a second position 44. A second linear actuator 46 such as a pneumatic cylinder, hydraulic cylinder, or the like, provides the selective powered movement of the guide means 40. The guide means 40 is supported by a plurality of bushings 48. These bushings 48 are sized to provide a sliding fit on a pair of horizontal shaft members 50. In order to minimize the space requirements for the second linear actuator 46, a rod-less type of actuator is used such as a magnetically coupled pneumatic cylinder which is manufactured by SMC®.

Referring particularly to FIG. 2, a lower portion of the guide means 40 includes at least one gating means 52. Each gating means 52 is selectively moveable between an open condition and a closed position. The open condition allows the free movement of a stack of nested lids from the lowermost position to an upper most position. The closed position provides for the support of the nested stack while allowing only the platform 20 to pass therethrough. Each gating means 52 includes a gate shoe 54 carried on at least one shaft member 5 6 .Each shaft member 56 is linearly slidable in a housing 58. The movement of the gating means 52 from an open condition to a closed condition is provided by a third linear actuator 60. This third linear actuator 60 may be pneumatically, hydraulically, or electrically operated. Each of the gate shoes 54 may have a radially contoured surface 62 to provide maximum clearance when in the open position while providing maximum support in the closed position. It is to be noted that the principles of the present invention may also be used with non-circular lids.

As previously mentioned the guide means 40 is moved from a first position 42 to a second position 44. The second position 44 is in vertical alignment with a magazine 64 of a lid placer. A typical magazine 64 is shown in dashed outline in FIG. 1. A second stop bar 66 is adjustably mounted to the frame 16 at the second positron 44. The second stop bar 66 provides a convenient mounting for a second detector 68, a third detector 70; and a fourth detector 72. The function of these detectors will be discussed later in the use and operation portion of this description.

It has been previously mentioned that the lid placer may be mounted directly to the frame 16. The frame 16 preferably, is adapted for mounting of the plate 74 of a lid placer. The lid placer, previously made reference to, will handle various types of metal and plastic lids. These lids may be delivered to the present invention in stacks which are not very stable. The U-shaped guide means 40 provides stabilization of the nested stack during the movement from the first position to the second position. The U-shape of the guide means 40 in cooperation with the second stop bar 66 provides an extension of the magazine 64 of the lid placer. This extension of the magazine stabilizes the stack of lids during the operation of the lid placer.

USE AND OPERATION

Figure 3A:
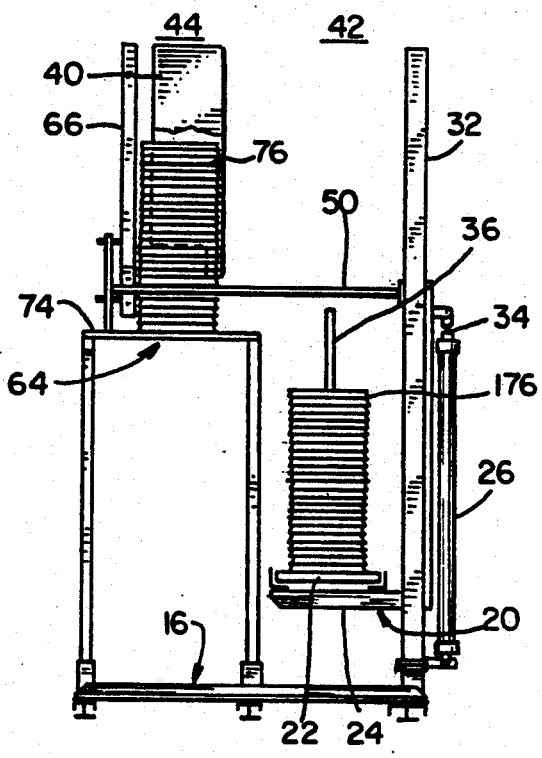
FIG. 3A represents an elevational view of the present invention, this view being partly diagrammatic and in a reduced scale, this view showing one of several steps in the operation of the apparatus.

Referring now to FIG. 3A through 3D, there is shown several steps in the operation of the apparatus 10. The first step as represented by FIG. 3A shows the magazine 64 of the lid placer partially filled with . a plurality of nested lids 76. These nested lids 76 are guided and stabilized on four sides by the guide 40 and the second stop bar 66. It is also to be mentioned that each gating means 52 is in the open condition to allow unrestricted passage of the lids 76 to the lid placer.

While the lid placer is separating and placing lids 76 on containers, an operator may place a stack of nested lids 176 on the platform 20. Of course in a manually loaded machine safety interlocks and guards would be used to prevent injury to an operator.

Figure 3B:
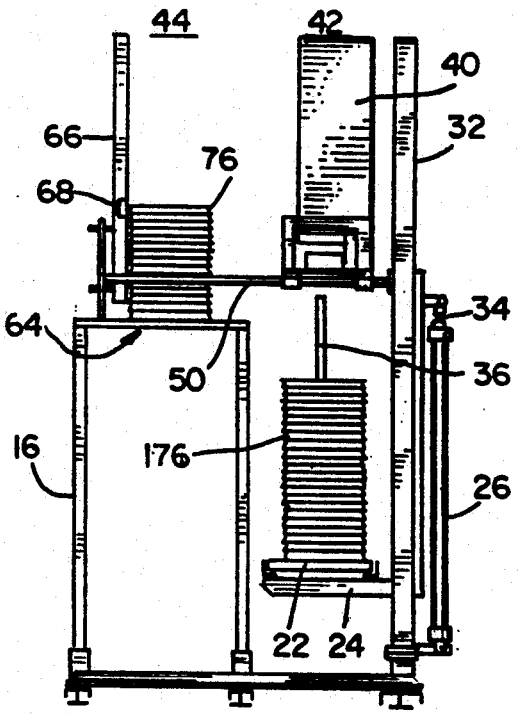
FIG. 3B represents a second step in the operation of the present invention.

Referring now to FIG. 3B, after the quantity of nested lids 76 in the magazine 64 has been reduced a sufficient amount, the guide means 40 returns to its first position. The determination to return the guide means 40 is made by second detector 68. The second detector 68 is vertically adjusted on the second stop bar 66 at a position at which the nested lids are self-aligning and stable. The presence of the stack of nested lids is detected by the first detecting means 38. The apparatus will proceed to the next step in its automatic operation only when a stack of nested lids is present on the platform 20.

Figure 3C:
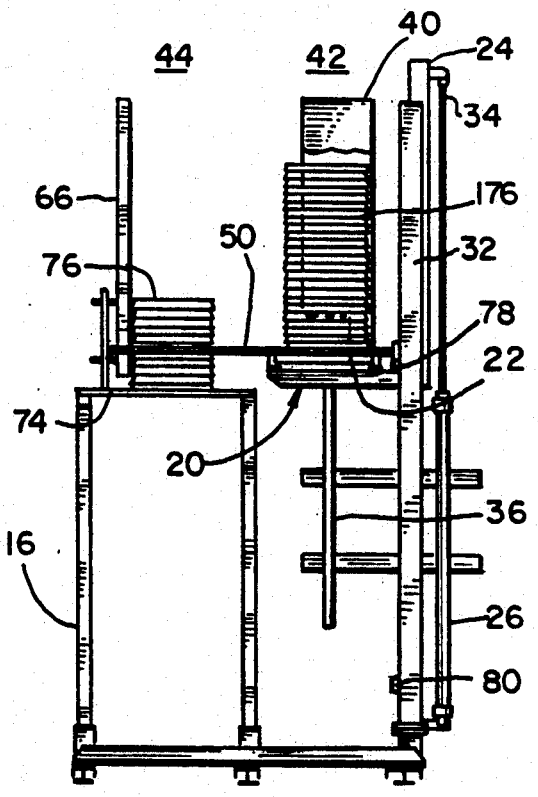
FIG. 3C represents a third step of the operation of the present invention.

Referring to FIG. 3C, this step in the sequence depicts the platform 20 with the stack of nested lids 176 thereon elevated from its lowermost position to an uppermost position. The uppermost position places the bottom of the nested stack 176 above the gating means 52. A fifth detector 78 and sixth detector 80 are used to determine the position of the platform 20. As previously mentioned, the powered elevating movement of the platform is provided by the first linear actuator 26. FIG. 3C shows the piston rod 34 of the linear actuator 26 in an extended condition. When the fifth detector 78 provides indication that the nested stack 176 is in its uppermost position, each gating means 52 is brought to a closed position for supporting the nested stack. In the mean time lids 76 are being separated and placed by the lid placer.

Figure 3D:
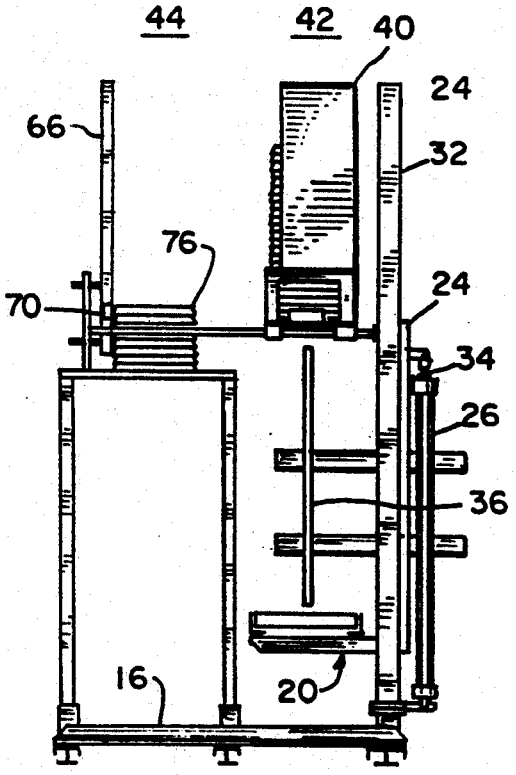
FIG. 3D represents a fourth step in the operation of the present invention.

Referring now to FIG. 3D, the platform is returned to its lowermost position after the gate means 52 supports the stack 176. The stack of nested lids 176 continue being held interior of the guide means at the first position until the third detector 70 provides a determination that the quantity of lids 76 in the magazine 64 have reached a predetermined level. The predetermined level allows the guide means 40 to move from the first position 42 to the second position 44. After the guide means 40 is positively positioned in vertical alignment with the magazine 64 of the lid placer, each gating means 52 is opened. This allows the stack of nested lids 176 to be deposited on the uppermost lid 76 in the magazine. The sequence of operation is then repeated without affecting the operation of the lid placer.

The operator has the option of loading a new stack of nested lids on the platform anytime while the empty platform is in the lowermost position.

CONTROL CIRCUIT OF FIG. 4

Figure 4:
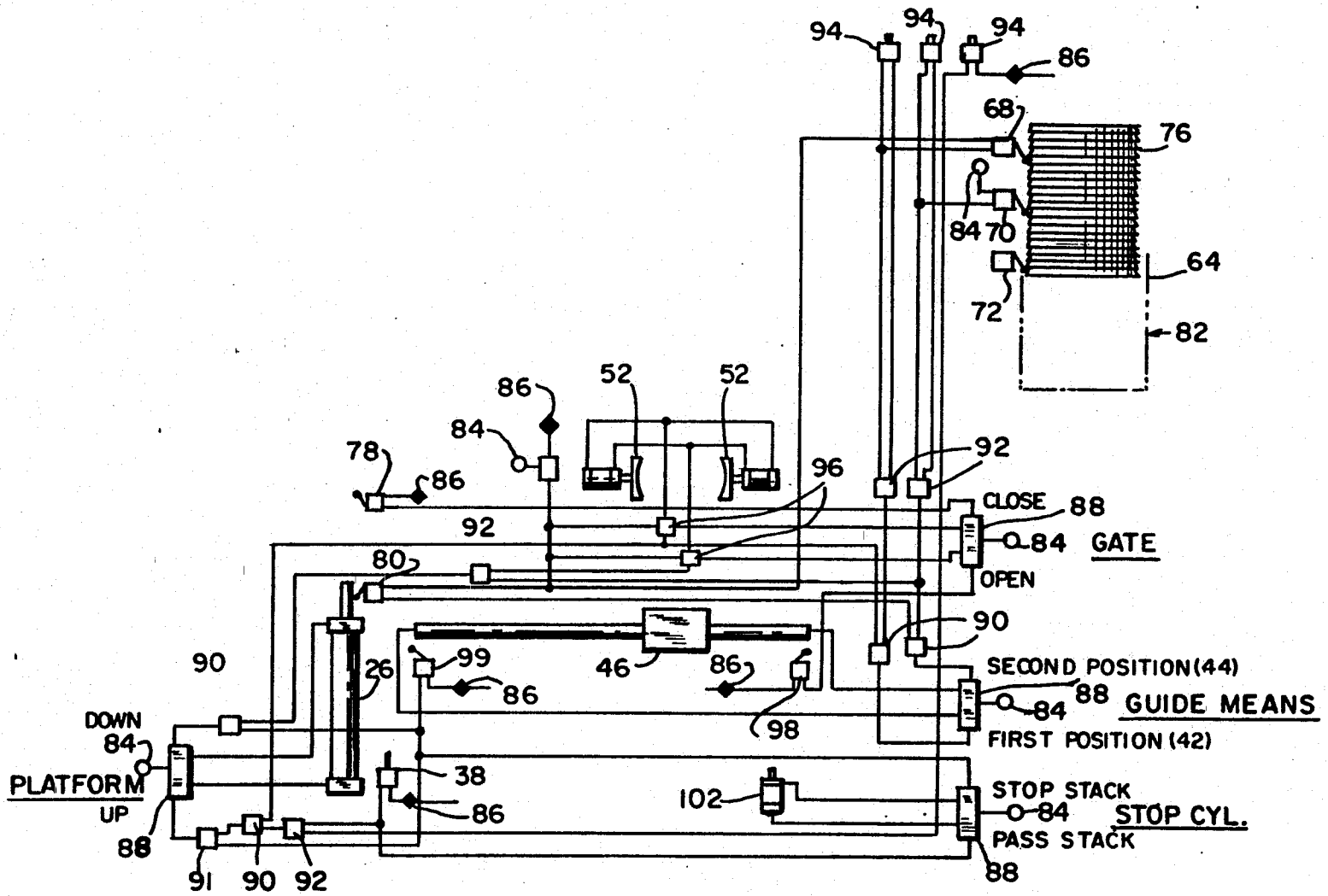
FIG. 4 represents a schematic of a typical basic control circuit for the automatic control of the present invention.

FIG. 4 represents a basic control circuit which may be used to operate the apparatus of the present invention. This control circuit shown is pneumatically operated and uses a pneumatic-logic pilot control circuit. Of course the pilot circuit may be electrically operated. Pneumatic logic is used in hazardous conditions. The powered regulated air 84 is supplied to various control valves. Operation of the valves is controlled by pilot air pressure 86. The circuit uses control valves 88; AND gates 90; YES gates 91; OR gates 92; Push buttons 94; and end of stroke sensors 96. The push buttons 94 allow for the manual operation of the various components in the circuit. The position of the guide means 20 is detected by a fifth detecting means 98 and a sixth detecting means 99.

The fourth detecting means 72 is provided to interface with the lid placer. This detector 72 will stop the lid placer and its associated conveyors when an insufficient number of lids are in the magazine 64.

It is to be noted that flow control valves, not shown, are suggested in the circuit to provide control of the rate of movement of the components. These flow control valves may be an integral part of the actuators or the valves.

DESCRIPTION OF FIG. 5

Figure 5:
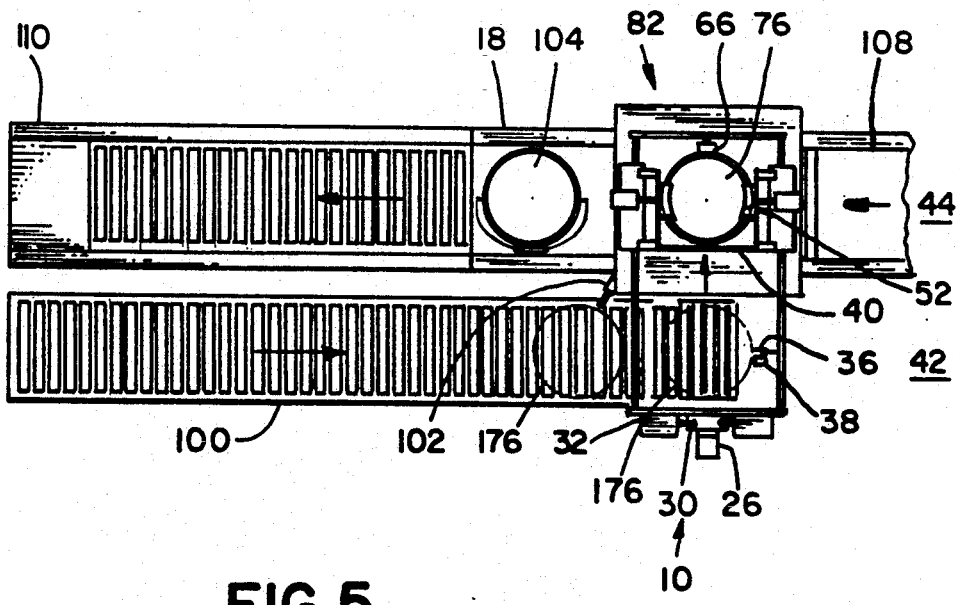
FIG. 5 represents a plan view showing a typical installation of the present invention in an assembly line, this view being partially diagrammatic.

FIG. 5 represents a typical plan view of the apparatus 10 being installed in a container covering assembly line. In this arrangment the apparatus 10 is connected with an infeed conveyor 100. This infeed conveyor 100 is of the moving roller type. This type of conveyor will allow the rollers to rotate relative to a stationary nested stack 176. This infeed conveyor 100 is fitted with a stop cylinder 102. This stop cylinder 102 meters the flow of stacks of nested lids onto the platform 20. The rollers of the infeed conveyor 100 allow multiple stacks of nested lids 176 to be accumulated thereon. The stop cylinder 102 will permit only one stack of nested lids 176 to be placed onto the platform 20 in its lowermost position.

It is to be noted that the apparatus of the present invention may be manufactured in a configuration as shown or in a mirror image. This versatile arrangement allows the present invention to be adapted to various material flow arrangements at the processing plant.

As depicted in FIG. 5, filled containers 104 are delivered to the lid placer 82 by a belt conveyor 108. After receiving its lid 76, the container 104 continues on the conveyor 18 towards a delivery or loading station 110. An operator may be stationed at the delivery station 110 to manually remove the covered container. It can be seen that this same operator can also load stacks of nested lids onto the infeed conveyor 100. This arrangement allows one operator to perform both tasks with minimal movement. If several machines converged at one point, the machine to operator ratio may be greater than one.

In its construction and use, the apparatus depicted and described above is believed to provide the basis for a method for the on demand conveying of stacks of nested lids to a lid placer. This method includes the steps of:

receiving a stack of nested lids on a platform member when said platform member is empty and in a lowermost position;

elevating said stack of nested lids to a first position interior of a guide means by vertically indexing said platform member to an uppermost position, said uppermost position being above a gating means carried on said guide means said gating means being held in an open position;

supporting said stack of nested lids interior of said guide means at said first position by first bring said gating means to a closed position after a positive determination by a fifth detector then, sequentially lowering said platform means to the lowermost position;

aligning said stack of nested lids over an uppermost lid in the magazine of the lid placer by horizontally shuttling the guide means with said stack of nested lids supported by said gating means from a first position to a second position, said shuttling being in response to a signal given by a first detector means, said first detector means sensing the quantity of lids in the magazine;

depositing the stack of nested lids onto said uppermost lid by bringing said gating means to the open position;

Stabilizing the deposited nested stack by maintaining the guide means at said second position to cooperate with a second stop member; and returning the guide means to said first position after a determined number of lids in the magazine have been dispensed.

Terms such as "left", "right", "up", down", "bottom", "top", "front", "back", "in", "out", and the like are applicable to the embodiments shown and described in conjunction with the drawings. These terms are merely for the purpose of description and do not necessarily apply to the position in which the on demand conveying apparatus of the present invention may be utilized.

While these particular embodiments of an improved apparatus and method have been shown and described, it is to be understood that the invention is not limited thereto and protection is sought to the broadest extent the prior art allows.

What is claimed is:

1. An apparatus for the on demand conveying of a stack of preformed and nested lids to a magazine of a lid placer, said apparatus comprising:

(a) a platform assembly which is adapted for receiving a stack of nested lids thereon, said platform assembly being further adapted for being selectively moved between a lowermost position and an uppermost position;

(b) a guide assembly which is sized for accepting said stack of nested lids interior thereof, said guide assembly including a gating means mounted at a lower portion thereof, said gating means being selectively moveable between an open condition and a closed condition said closed condition providing for said stack of nested lids to be supported thereon while allowing said platform assembly to pass therethrough, said guide assembly further adapted for being horizontally shuttled between a first position and a second position, said first position being in a selective spaced and vertical relationship with the lowermost position of the platform assembly, said second position being in substantial vertical alignment with the magazine of said lid placer; and (c) wherein said platform assembly with said stack-of nested lids thereon is selectively elevated to said uppermost position so that said stack of nested lids is disposed interior of said guide assembly and completely above said gating means when said gating means is in the open condition, said gating means being selectively brought to the closed condition first, immediately followed by lowering said platform to said lowermost position so that said stack of said nested lids is supported at said first position by said gating means in said closed position, said guide assembly and gating means with said nested stack therein and thereon being selectively shuttled from said first position to said second position, said gating means being selectively brought to the open condition for depositing said nested stack of lids on an uppermost lid being held in said magazine.

2. An apparatus as recited in claim 1 wherein said platform assembly includes:

a platform member carried on a platform support, said platform support being linearly guided on a pair of vertically disposed shaft members;

a first linear actuator having its rod end pivotally connected to a selected point of said platform support, said first linear actuator having its end distal said rod end pivotally connected to a frame of said apparatus.

3. An apparatus as recited in claim 2 wherein said platform support is L-shaped, with said first linear actuator connected to one leg of said platform support and said platform member is attached to a second leg of said platform support.

4. An apparatus as recited in claim 3 wherein each of the vertically disposed shaft members is supported by a column member, each vertically disposed shaft member having at least one intermediate support member and said platform support having at least one open type bushing member carried therein for providing said linear movement along each vertically disposed shaft member.

5. An apparatus as recited in claim 2 which includes an infeed conveyor, said infeed conveyor having a plurality of linearly moveable and rotatable rollers, said infeed conveyor being capable of conveying a plurality of said stacks of nested lids toward said platform member; and said infeed conveyor further including a stop cylinder selectively mounted thereon, said stop cylinder being selectively actuated for releasing only one of said stacks of nested lids onto an empty platform member, and any subsequent stacks of nested lids are retained on said infeed conveyor while said rotatable rollers pass under the retained nested stacks.

6. An apparatus as recited in claim 5 wherein said platform member includes a plurality of platform rollers, each of the platform rollers being rotatably carried and arrayed on said platform support for fully receiving any stacks of nested lids released from said infeed conveyor by said stop cylinder.

7. An apparatus as recited in claim 1 wherein said guide assembly includes an elongated U-shaped guide member, said U-shaped guide member being vertically disposed to receive the stack of nested lids elevated by said platform assembly, said U-shaped guide member being- linearly carried on a pair of horizontally disposed shaft members;

a second linear actuator which is adapted for the selective and powered movement of said guide assembly between said first position and said second position; and wherein said U-shaped guide member stabilizes said stack of nested lids at said first position, said second position, and during said horizontal shuttling.

8. An apparatus as recited in claim 1 wherein said U-shaped Guide member and a second stop bar cooperate to provide a 4-sided stabilization of said stack of nested lids being deposited into said magazine.

9. An apparatus as recited in claim 8 wherein each gating means includes a gate shoe member, each gate shoe member having a contoured surface for providing a clearance, when in said open condition, for said nested lids passing therby, said contoured surface also providing a maximum support for the stack of nested lids when in the closed condition.

10. An apparatus as recited in claim 7 wherein said second linear actuator is a rod-less pneumatic type and is magnetically coupled to the guide member.

11. A method for the on-demand conveying of a stack of preformed and nested lids to a magazine of a lid placer including the steps of:

(a) receiving a stack of nested lids on a platform assembly when said platform assembly in a lowermost position;

(b) elevating said stack of nested lids to a first position interior of a guide assembly by vertically indexing said platform assembly to an uppermost position above a gating means carried on said guide assembly;

(c) supporting said stack of nested lids interior of said guide assembly at said first position by first, bringing said gating means to a closed posit-ion then, sequentially lowering said platform assembly to said lowermost position;

(d) aligning said stack of nested lids over an uppermost lid in the magazine of said lid placer by shuttling said guide assembly with said stack of nested lids supported by said gating means from said first position to a second position, said shuttling being in response to a signal given by a first level sensing means;

(e) depositing said stack of nested lids onto said uppermost lid by opening said gating means; and (f) returning said guide assembly to said first position after a determined number of the lids in the magazine have been dispensed.

12. A method as recited in claim 11 which includes the further step of:

stabilizing said stack of nested lids during said horizontal shuttling from said first position to said second position by carrying said stack of nested lids interior of an elongated U-shaped guide member.

13. A method as recited in claim 12 which includes the further step of stabilizing the deposited stack of nested lids by detaining said U-shaped guide member at said second position, said U-shaped guide member cooperating with a second stop bar to guide said deposited stack of nested lids therebetween.

* * * * *